US008426781B2

(12) United States Patent
Kim et al.

(10) Patent No.: US 8,426,781 B2
(45) Date of Patent: Apr. 23, 2013

(54) INDUCTION HEATER

(75) Inventors: Won Tae Kim, Seoul (KR); Seung Hee Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 245 days.

(21) Appl. No.: 12/528,207

(22) PCT Filed: Feb. 22, 2008

(86) PCT No.: PCT/KR2008/001056

§ 371 (c)(1),
(2), (4) Date: Mar. 16, 2010

(87) PCT Pub. No.: WO2008/103009

PCT Pub. Date: Aug. 28, 2008

(65) Prior Publication Data

US 2010/0187222 A1 Jul. 29, 2010

(30) Foreign Application Priority Data

Feb. 24, 2007 (KR) ..... 10-2007-0018748

(51) Int. Cl.

| | |
|---|---|
| ***H05B 6/12*** | (2006.01) |
| ***H05B 6/10*** | (2006.01) |
| ***H05B 6/42*** | (2006.01) |
| ***F24C 15/32*** | (2006.01) |

(52) U.S. Cl.
USPC ..... 219/623; 219/632; 219/677; 126/21 A

(58) Field of Classification Search ..... 219/632, 219/623, 677, 620, 622, 660; 126/21 R, 126/21 A, 1 AD; 99/DIG. 14
See application file for complete search history.

(56) References Cited

U.S. PATENT DOCUMENTS

| | | | | |
|---|---|---|---|---|
| 5,091,823 | A * | 2/1992 | Kanbara et al. | 361/697 |
| 6,483,699 | B1 * | 11/2002 | Salmonson et al. | 361/679.51 |
| 7,135,661 | B2 * | 11/2006 | Park et al. | 219/623 |
| 7,209,352 | B2 * | 4/2007 | Chen | 361/695 |
| 2004/0246678 | A1 * | 12/2004 | Lin et al. | 361/697 |

FOREIGN PATENT DOCUMENTS

| | | |
|---|---|---|
| CN | 2518144 | 10/2002 |
| CN | 1805626 | 7/2006 |
| JP | 11-087040 | 3/1999 |
| JP | 2000-100553 | 4/2000 |
| JP | 2002-198163 | 7/2002 |
| JP | 2003-272817 | 9/2003 |
| JP | 2004-172138 A * | 6/2004 |

(Continued)

OTHER PUBLICATIONS

English translation of the specification JP 2004-172138, Kataoka et al., Jun. 2004.*

(Continued)

*Primary Examiner* — Henry Yuen
*Assistant Examiner* — Hung D Nguyen
(74) *Attorney, Agent, or Firm* — KED & Associates, LLP

(57) ABSTRACT

Provided is an induction heater which induces an electric current in a metal utensil (e.g., a cooking utensil) using an electromagnetic force and can thus heat the metal utensil, and more particularly, an induction heater which can prevent electric devices sensitive to temperature from being overheated by forcefully blowing air to the front and the rear of an inverter circuit board. The induction heater is easy to be miniaturized, and a considerable number of devices can be integrated into the induction heater.

17 Claims, 5 Drawing Sheets

FOREIGN PATENT DOCUMENTS

| | | | |
|---|---|---|---|
| JP | 2004-265871 | A * | 9/2004 |
| JP | 2005/019194 | | 1/2005 |
| JP | 2005-063777 | | 3/2005 |
| JP | 2005-190753 | | 7/2005 |
| TW | 543839 | | 7/2003 |

OTHER PUBLICATIONS

English translation of Abstract JP 2004-172138, Kataoka et al., Jun. 2004.*

Abstract—English Translation of Okada et al., JP 2004-265871, Sep. 24, 2004.*

Specification—English Translation of Okada et a., JP 2004-265871, Sep. 24, 2004.*

Chinese Office Action dated Apr. 29, 2011 (Application No. 200880005950.6).

International Search Report dated Jun. 30, 2008.

European Search Report issued in EP Application No. 08723094.2 dated Jul. 4, 2012.

* cited by examiner

[Fig. 1]
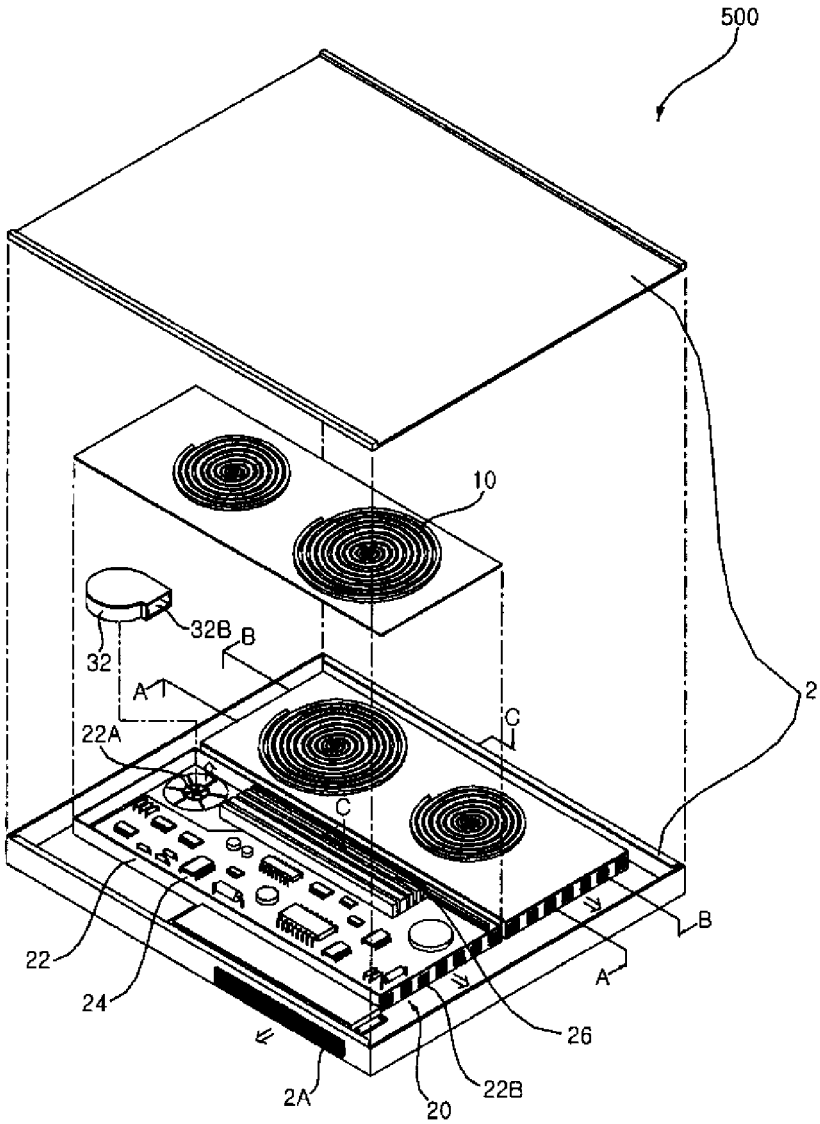

[Fig. 2]
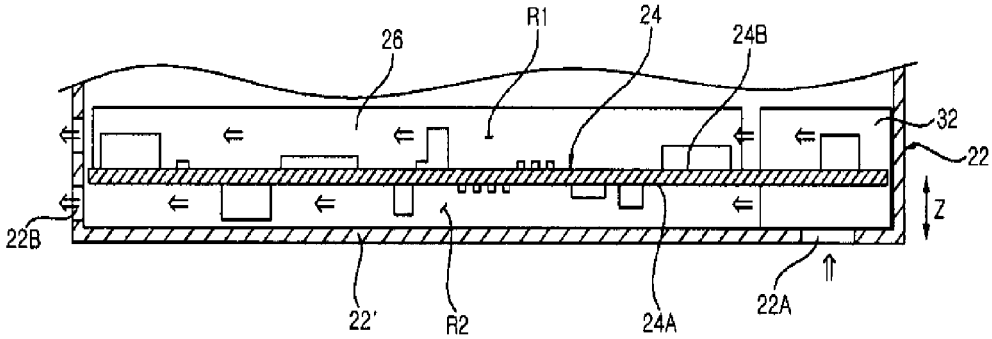
[Fig. 3]
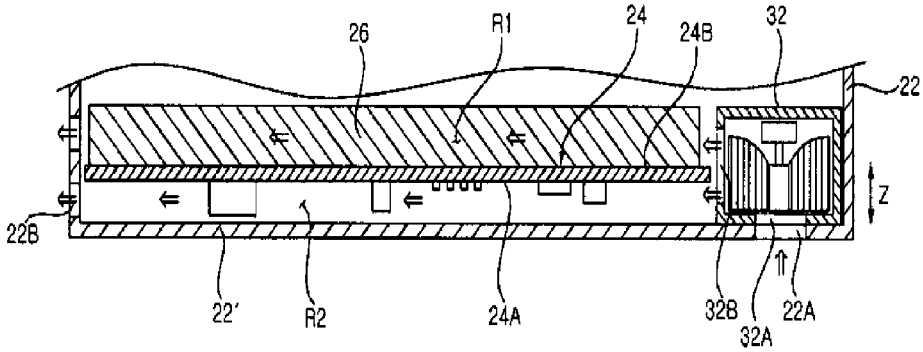

[Fig. 4]
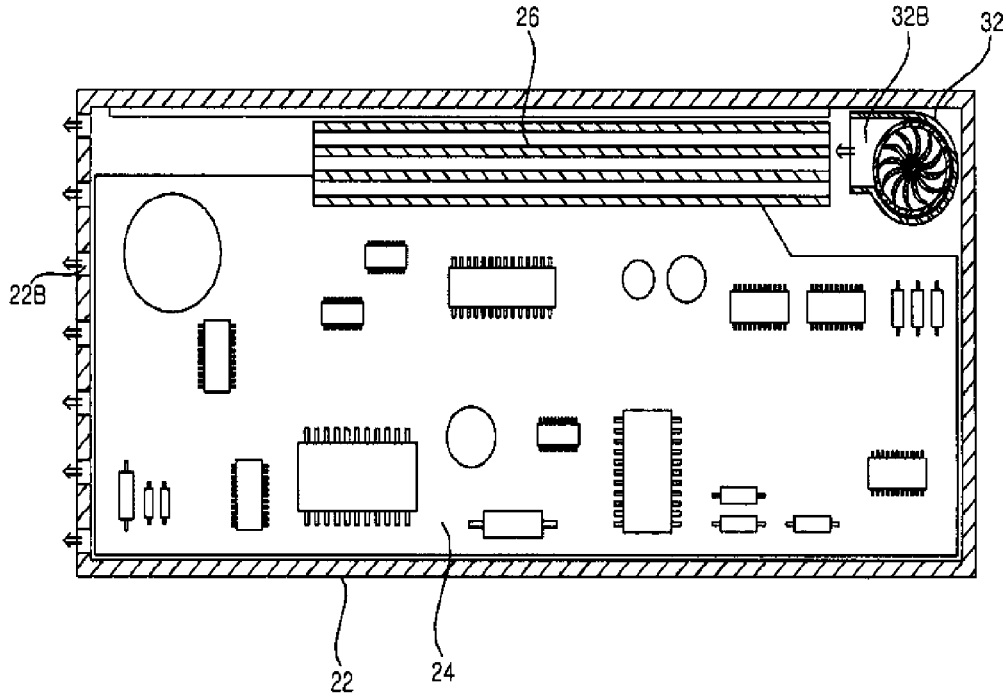
[Fig. 5]
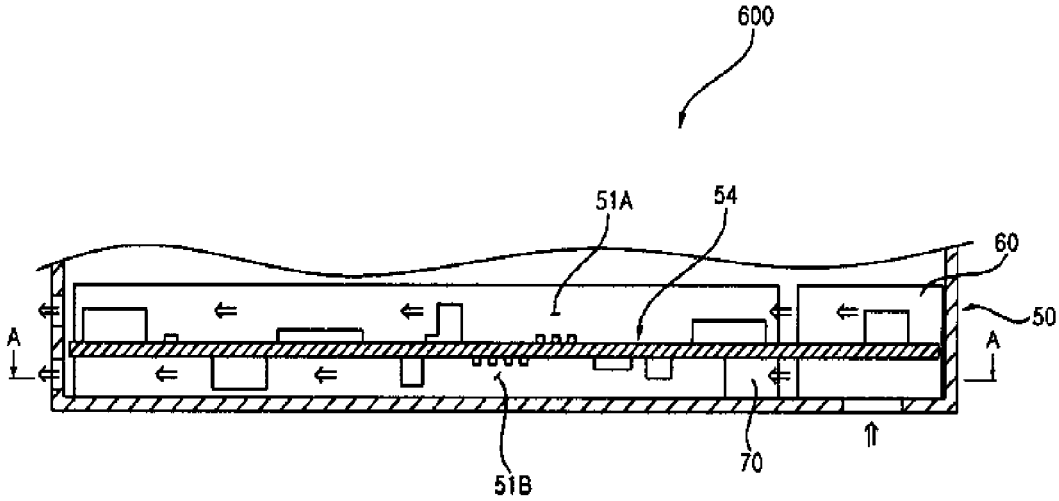

[Fig. 6]
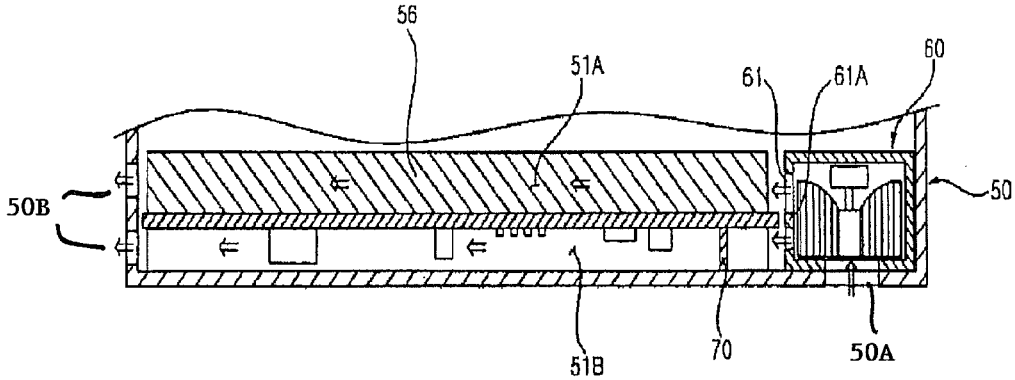
[Fig. 7]
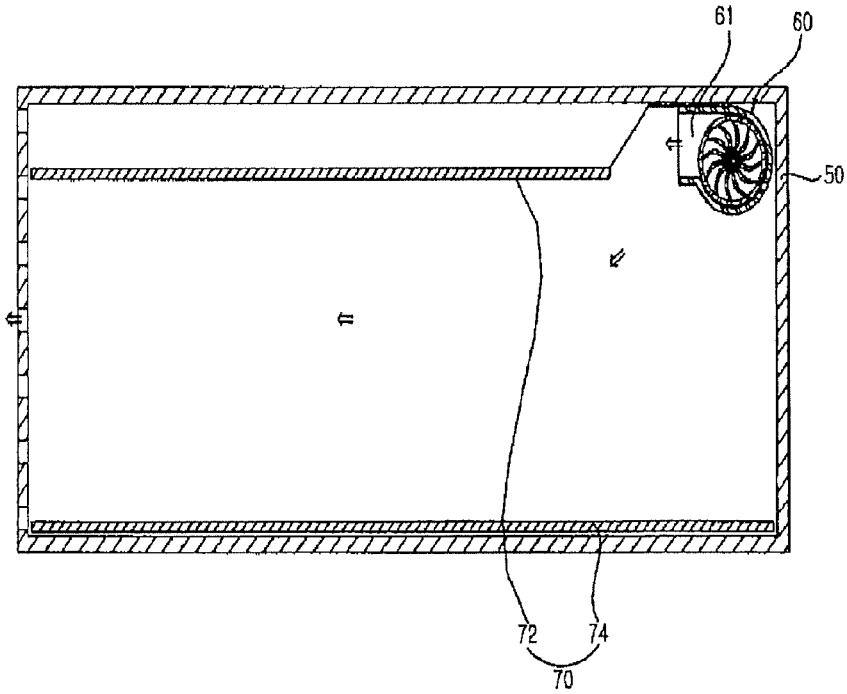

[Fig. 8]
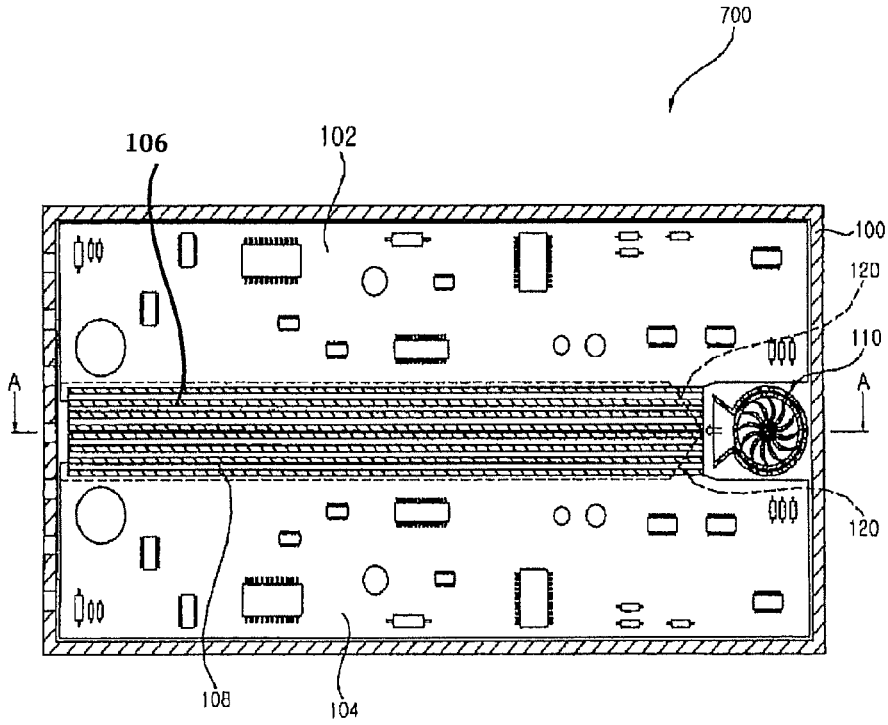
[Fig. 9]
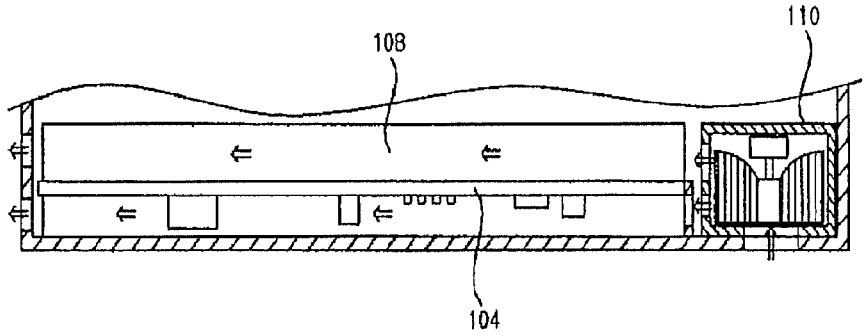

INDUCTION HEATER

TECHNICAL FIELD

The present invention relates to an induction heater, and more particularly, to an induction heater which can cool an inverter circuit board with air.

BACKGROUND ART

Induction heaters induce an electric current in a metal utensil (e.g., a cooking utensil) using an electromagnetic force and can thus heat the metal utensil. Induction heaters have been widely used in electronic cooking devices, rice cookers, and electric kettles.

Induction heaters generate a considerable amount of heat using an electromagnetic force. Thus, if induction heaters are overheated, electric devices in induction heaters that are sensitive temperature may be damaged and may cause a fire. In particular, given that induction heaters used in cooking devices are generally required to have a high heating power, and that the demand for miniaturized induction heaters to fit in built-in kitchen furniture has steadily grown, it is necessary to develop induction heaters which have a sufficient heating power, are small in size, and have an effective air cooling function and can thus prevent the above-mentioned problems regarding overheating from arising.

DISCLOSURE OF INVENTION

Technical Problem

The present invention provides an induction heater which has an air cooling function and can thus prevent an inverter circuit board from being overheated.

Technical Solution

According to an aspect of the present invention, there is provided an induction heater including an inverter body; an inverter circuit board which is provide within the inverter body; and a heat dissipater which is configured to blows air to a front and a rear of the inverter circuit board.

The heat dissipater may include an inverter heat dissipation blower which is configured to blows air into at least one of a first inverter heat dissipation space and a second inverter heat dissipation space, wherein the first inverter heat dissipation space is provided between a top surface of the inverter circuit board and the inverter body and wherein the second inverter heat dissipation space is provided between a bottom surface of the inverter circuit board and the inverter body.

A first portion of an outlet of the inverter heat dissipation blower may be configured to blow into the first inverter heat dissipation space, and a second portion of the outlet of the inverter heat dissipation blower may be configured to blow into the second inverter heat dissipation space.

The induction heater may also include an outlet divider which divides the outlet of the inverter heat dissipation blower into the first and second portions.

The induction heater may also include a heat sink which is provided on the top surface of the inverter circuit board, and wherein the heat sink dissipates heat from the inverter circuit board, wherein the outlet divider divides the outlet of the inverter heat dissipation blower so that more air is blown into the first inverter heat dissipation space than into the second inverter heat dissipation space.

The inverter body may include a plurality of inverter body outlets is configured to allow passage of air blown by the inverter heat dissipation blower can be ejected from the inverter body, and the inverter body outlets may include a first inverter body outlet configured to blow air into the first inverter heat dissipation space and a second inverter body outlet configured to blow air into the second inverter heat dissipation space.

The inverter body may include an inverter body outlet configured to allow passage of air blown by the inverter heat dissipation blower can be ejected from the inverter body, and the inverter body outlet may include a first portion configured to blow air into to the first inverter heat dissipation space and a second portion corresponding to the second inverter heat dissipation space.

The heat dissipater may include an inverter guide which is provided between the inverter body and the inverter circuit board, wherein the inverter is configured to guide air, blown by the inverter, to the inverter circuit board.

The inverter guide may be configured to support the inverter circuit board so that the inverter circuit board can be stably placed in the inverter body.

The heat dissipater may include an inverter guide which is configured to guide air, blown by the inverter heat dissipation blower into the second inverter heat dissipation space.

The inverter body may have a substantially rectangular inner space, and the inverter heat dissipation blower may be provided at a corner of the rectangular inner space of the inverter body.

The inverter body may include an inverter body inlet which is provided on a bottom surface of the inverter body, wherein the inverter body inlet in configured to allow passage of the air blown by the inverter heat dissipation blower into the inverter body; and an inverter body outlet which is provided on one side of the inverter body, wherein the inverter body outlet is configured to allow passage of the air blown by the inverter heat dissipation blower to an outside of the inverter body.

The inverter circuit board may include both a first inverter circuit board and a second inverter circuit board which are both provided within the inverter body, and the induction heater may also include a first heat sink which is provided on the first inverter circuit board and dissipates heat from the first inverter circuit board and a second heat sink which is provided on the second inverter circuit board and dissipates heat from the second inverter circuit board. The first and second heat sinks may be provided in a space between the first inverter circuit board and the second inverter circuit board in the vicinity of each other.

The heat dissipater may include a first inverter heat dissipation blower which is configured to blows air to the first inverter circuit board, wherein the first inverter heat dissipation blower corresponds to the first heat sink; and a second inverter heat dissipation blower which blows air to the second inverter circuit board, wherein the first heat dissipation blower corresponds to the second heat sink.

The heat dissipater may include an inverter heat dissipation blower which is configured to blows air to the first and second inverter circuit boards and corresponds to both the first and second heat sinks.

The heat dissipater may also include a first inverter guide which is configured to guide the air blown by the first inverter heat dissipation blower to the first inverter circuit board, but not to the first heat sink; and a second inverter guide which is configured to guide the air blown by the second inverter heat dissipation blower to the second inverter circuit board, but not to the second heat sink.

The induction heater may also include one or more induction coils which are provided on the inverter body and generate an induction field.

According to another aspect of the present invention, there is provided an induction heater including an inverter circuit board; an inverter body which defines a space configured to receive the inverter circuit board; and an heat dissipater which configured to blow both a main air stream to a first portion of the inverter circuit board and a sub-air stream to a second portion of the inverter circuit board.

The first portion of the inverter circuit board may include a front of the inverter circuit board, and the second portion of the inverter circuit board may include a rear of the inverter circuit board.

The heat dissipater may in configured to support the inverter circuit board.

BRIEF DESCRIPTION OF THE DRAWINGS

FIG. 1 illustrates a perspective view of an induction heater according to an embodiment of the present invention;

FIG. 2 illustrates a cross-sectional view taken along line A-A of FIG. 1;

FIG. 3 illustrates a cross-sectional view taken along line B-B of FIG. 1;

FIG. 4 illustrates a cross-sectional view taken along line C-C of FIG. 1;

FIG. 5 illustrates a side-sectional view of an induction device according to other embodiment of the present invention and corresponds to FIG. 2;

FIG. 6 illustrates another side-sectional view of the induction device illustrated in FIG. 5 and corresponds to FIG. 3;

FIG. 7 illustrates a cross-sectional view taken along line A-A of FIG. 5;

FIG. 8 illustrates a cross-sectional view of an induction heater according to another embodiment of the present invention and corresponds to FIG. 4; and FIG. 9 illustrates a side-sectional view taken along line A-A of FIG. 8.

MODE FOR THE INVENTION

The present invention will hereinafter be described in detail with reference to the accompanying drawings in which exemplary embodiments of the invention are shown.

FIGS. 1 through 4 illustrate an induction heater 500 according to an embodiment of the present invention. Referring to FIGS. 1 through 4, the induction heater 500 includes a main body 2 in which a cooking utensil that can be inductively heated is settled; induction coils 10 which are disposed in the main body 2 and generate an induction field so that an electric current can be applied to the cooking utensil, and that the cooking utensil can be heated; at least one inverter circuit unit 20 which drives the induction coils 10; and an heat dissipater which can forcefully cool the inverter circuit unit 20 and can thus dissipate heat from the inverter circuit unit 20 so that electric devices in the inverter circuit unit 20, which are sensitive to temperature, can be protected against heat generated by the inverter circuit unit 20.

The main body 2 includes an air inlet/outlet 2A through which air can be injected into or ejected from the main body 2 by the heat dissipater. The air inlet/outlet 2A may be formed as a hole so as to be directly connected to the outside of the main body 2. A duct may be connected to the air inlet/outlet 2A.

The inverter circuit unit 20 includes an inverter body 22 which has an empty space therein and an inverter circuit board 24 which is connected to the induction coils 10.

The inverter body 22 is formed through a mold process and can thus be insulated. The inverter body 22 includes an inverter body inlet 22A which is disposed on one side of the inverter body 22 and through which air blown by the heat dissipater can be injected into the inverter body 22; and an inverter body outlet 22B which is disposed on the other side of the inverter body 22 and through which air can be ejected from the inverter body 22. Due to the inverter body inlet 22A and the inverter body outlet 22B, the inverter body 22 can be cooled by air blown by the heat dissipater. A plurality of inverter body outlets 22B may be provided for respective corresponding inverter heat dissipation spaces (i.e., first and second inverter heat dissipation spaces R1 and R2) at the inverter body 22. Alternatively, only one inverter body outlet 22B may be provided so that the first and second inverter heat dissipation spaces R1 and R2 can share the inverter body outlet 22B with each other.

The inverter circuit board 24 is installed in the inverter body 22 so that a bottom surface 24A of the inverter circuit board 24 can be a predetermined distance apart from a surface of the inverter body 22 that faces the bottom surface 24A, i.e., a bottom surface 22' of the inverter body 22. The inverter circuit board 24 may be inserted into and fixed to the inverter body 22 during the fabrication of the inverter body 22. The inverter circuit board 24 may be coupled and fixed to the inverter body 22 using a coupling element such as a screw, a rivet, or a hook. The inverter circuit board 24 may be bonded and fixed to the inverter body 22 through welding, bonding or soldering. As described above, since the bottom surface 24A of the inverter circuit board 24 is spaced apart from the bottom surface 22' of the inverter body 22, electric devices may be mounted even on the bottom surface 24A of the inverter circuit board 24. Thus, it is possible to miniaturize the inverter circuit board 24, compared to the case where electric devices can be mounted only on a top surface 24B of the inverter circuit board 24. In addition, it is possible to secure a space for the electric devices on the bottom surface 24A of the inverter circuit board 24 to be directly cooled by the heat dissipater.

A heat sink 26 may be disposed on at least one of the top surface 24B and the bottom surface 24A of the inverter circuit board 24, and particularly, on the top surface 24B of the inverter circuit board 24 for dissipating heat from the electric devices on the inverter circuit board 24. The heat sink 26 protrudes beyond the inverter circuit board 24.

The heat dissipater includes an inverter heat dissipation blower 32 which forcefully blows air to the front and to the rear of the inverter circuit board 24 and can thus cool the inverter circuit unit 20. That is, the inverter heat dissipation blower 32 forcefully blows air to the first inverter heat dissipation space R1 between the top surface 24B of the inverter circuit board 24 and the inverter body 22 and to the second inverter heat dissipation space R2 between the bottom surface 24A of the inverter circuit board 24 and the inverter body 22.

For this, the inverter heat dissipation blower 32 may be installed in the inverter body 22. Then, air blown by the inverter heat dissipation blower 32 may readily face toward the inverter circuit board 24. That is, it is possible to prevent the leakage of air blown by the inverter heat dissipation blower 32. The inverter heat dissipation blower 32 may be a predetermined distance apart from the inverter circuit board 24 so that air blown by the inverter heat dissipation blower 32 can smoothly spread toward the inverter circuit board 24.

An inlet 32A of the inverter heat dissipation blower 32 is connected to the inverter body inlet 22A, which is disposed on the bottom surface 22' of the inverter body 22. Since the inverter heat dissipation blower 32 can be stably mounted in the inverter body 22 by being placed in contact with the bottom surface 22' of the inverter body 22, no additional structure for supporting the inverter heat dissipation blower 32 or no additional element such as a duct for injecting air into the inverter heat dissipation blower 32 is necessary.

A portion of the outlet 32B of the inverter heat dissipation blower 32 may correspond to the first inverter heat dissipation space R1, and the remaining portion of the outlet 32B of the inverter heat dissipation blower 32 may correspond to the second inverter heat dissipation space R2. More specifically, referring to FIGS. 2 and 3, the first and second inverter heat dissipation spaces R1 and R2 are vertically arranged, as indicated by reference character Z. Thus, an upper portion of the outlet 32B of the inverter heat dissipation blower 32 may correspond to the first inverter heat dissipation space R1, and a lower portion of the outlet 32B of the inverter heat dissipation blower 32 may correspond to the second inverter heat dissipation space R2. The ratio of the area of the outlet 32B facing the first inverter heat dissipation space R1 and the area of the outlet 32B facing the second inverter heat dissipation space R2 may be determined according to the amount of heat generated from the front and the rear of the inverter circuit board 22. That is, if more heat is generated from the front of the inverter circuit board 22 than from the rear of the inverter circuit board 22, the outlet 32B may be formed so that the area of the outlet 32B facing the first inverter heat dissipation space R1 can become greater than the area of the outlet 32B facing the second inverter heat dissipation space R2. In this manner, it is possible to effectively cool not only the front but also the rear of the inverter circuit board 24 using only one inverter heat dissipation blower 32.

The inverter heat dissipation blower 32 may be disposed so that the inverter heat dissipation blower 32 can correspond to the heat sink 26, and that the heat sink 26 can be directly cooled by the heat dissipater. If the induction heater 500 includes more than one inverter circuit unit 20, a plurality of heat dissipaters may be provided for the respective inverter circuit units 20. Alternatively, the heat dissipater may be commonly shared by two or more inverter circuit units 20.

The operation of the induction heater 500 will hereinafter be described in detail.

Once the inverter heat dissipation blower 32 is driven, blowing power that can forcefully blow air is generated. Due to the blowing power of the inverter heat dissipation blower 32, air flows into the inverter body 22 through a cooling hole 22C, which is disposed on one side of the inverter body 22. Then, the air injected into the inverter body 22 is divided into two air streams that respectively flow into the first and second inverter heat dissipation spaces R1 and R2. The two air streams respectively injected into the first and second inverter heat dissipation spaces R1 and R2 are ejected from the inverter body 22 through the inverter body outlet 22B due to the blowing power of the inverter heat dissipation blower 32. Therefore, not only the electric devices on the top surface 24B of the inverter circuit board 24 but also the electric devices on the bottom surface 24A of the inverter circuit board 24 can be effectively cooled due to the blowing power of the inverter heat dissipation blower 32.

FIGS. 5 through 7 illustrate an induction heater 600 according to another embodiment of the present invention. The induction heater 600 will hereinafter be described in detail, focusing mainly on the differences with the induction heater 500 of the embodiment of FIGS. 1 through 4. Referring to FIGS. 5 through 7, the induction heater 600 includes an inverter heat dissipation blower 60 which generates blowing power in first and second inverter heat dissipation spaces 51A and 51B, respectively, of an inverter body 50 so that a top surface and a bottom surface of an inverter circuit board 54 in the inverter body 50 can both be cooled; and an inverter guide 70 which is disposed between the inverter body 50 and the inverter circuit board 54 and is connected to the inverter heat dissipation blower 60.

Due to the inverter guide 70, the inverter heat dissipation blower 60 may be installed in such a manner that an outlet 61 of the inverter heat dissipation blower 60 can correspond to both the first and second inverter heat dissipation spaces 51A and 51B, like in the embodiment of FIGS. 1 through 4, or correspond only to the first inverter heat dissipation 51A. Thus, the inverter heat dissipation blower 60 may be freely installed in the inverter body 50 due to the inverter guide 70.

More specifically, in the embodiment of FIGS. 5 through 7, like in the embodiment of FIGS. 1 through 4, the inverter heat dissipation blower 60 may be installed in the inverter body 50 so that the outlet 61 of the inverter heat dissipation blower 60 can correspond to both the first and second heat dissipation spaces 51A and 51B. In this case, the inverter heat dissipation blower 60 may also include an outlet divider 61A which divides the outlet 61 into two portions respectively facing the first and second inverter heat dissipation spaces 51A and 51B. The outlet divider 61A may or may not protrude beyond the inverter heat dissipation blower 60. Due to the outlet divider 61A, the blowing power of the inverter heat dissipation blower 60 can be prevented from being too much concentrated on one of the first and second inverter heat dissipation spaces 51A and 51B.

The inverter guide 70 may include a plurality of guide ribs 72 and 74 which guide the blowing power of the inverter heat dissipation blower 60 into the second inverter heat dissipation space 51B and support the inverter circuit board 52. Two or more guide ribs 72 and 74 may be provided according to how many sections the second inverter heat dissipation space 51B is divided into.

The guide ribs 72 and 74 may extend from an inlet 50A of the inverter body 50 to an outlet 50B of the inverter body 50 so that the blowing power of the inverter heat dissipation blower 60 can be effectively guided to the outlet 50B of the inverter body 50. Since the inverter circuit board 54 is firmly supported by the guide ribs 72 and 74, no additional element for supporting the inverter circuit board 54 a predetermined distance apart from the bottom of the inverter body 50 is necessary.

If the inverter heat dissipation blower 60 is disposed on one side of the inverter circuit board 54 and is thus close to the heat sink 56, an end portion of the inverter guide 70 near the inverter heat dissipation blower 60 may extend toward the heat sink 56. That is, an end portion of the guide rib 72, which is closer than the guide rib 74 to the heat sink 56, may be bent toward the heat sink 56. In this case, it is possible to prevent the leakage of air blown by the inverter heat dissipation blower 60 and supply sufficient air to the second inverter heat dissipation space 51B.

In the embodiment of FIGS. 5 through 7, the outlet divider 61A is provided at the outlet 61 of the inverter heat dissipation blower 60, and the inverter guide 70 is provided. Thus, it is possible to more effectively dissipate heat from the inverter circuit board 52 than in the embodiment of FIGS. 1 through 4.

FIGS. 8 and 9 illustrate an induction heater 700 according to another embodiment of the present invention. The induction heater 700 will hereinafter be described in detail, focusing mainly on the differences with the induction heater 500 of the embodiment of FIGS. 1 through 4. Referring to FIGS. 8 and 9, the induction heater 700 includes a plurality of inverter circuit boards, i.e., first and second inverter circuit boards 102 and 104 which are disposed in an inverter body 100; first and second heat sinks 106 and 108 which are respectively disposed on the first and second inverter circuit boards 102 and 104; an inverter heat dissipation blower 110 which dissipates heat from the first and second inverter circuit boards 102 and 104; and an inverter guide 120 which guides air blown by the inverter heat dissipation blower 110 to the first and second inverter circuit boards 102 and 104.

The first and second inverter circuit boards 102 and 104 are spaced apart from each other, and the first and second heat sinks 106 and 108 are disposed between the first and second inverter circuit boards 102 and 104. Since the inverter heat dissipation blower 110 corresponds to both the first and second heat sinks 106 and 108, not only the front but also the rear of the first and second inverter circuit boards 102 and 104 can be cooled by the inverter heat dissipation blower 110.

The inverter guide 120 is provided so that the blowing power of the inverter heat dissipation blower 110 can be transmitted to a distant part of the heat dissipation space between the inverter body 100 and rear portions of the first and second inverter circuit boards 102 and 104. The inverter guide 120 may be equipped with a duct and may thus generate a closed air passage in a heat dissipation space at the rear of the inverter heat dissipation blower 110 or at the rear of the first and second inverter circuit boards 102 and 104. In this manner, it is possible to minimize the leakage of air blown by the inverter heat dissipation blower 110.

INDUSTRIAL APPLICABILITY

According to the present invention, the front and the rear of an inverter circuit board can both be forcefully cooled with air. Thus, it is possible to prevent an inverter circuit board from being overheated, to miniaturize an inverter circuit board, to integrate more devices into an inverter circuit board, and to thinly fabricate an inverter circuit board.

In addition, according to the present invention, a portion of an outlet of an inverter heat dissipation blower corresponds to the front of an inverter circuit board, and the remaining portion of the outlet of the inverter heat dissipation blower corresponds to the rear of the inverter circuit board. Thus, it is possible to provide an induction heater having only one inverter heat dissipation blower without a requirement of an additional duct. In addition, it is possible to effectively divide the blowing power of an inverter heat dissipation blower by using an outlet divider that divides an outlet of the inverter heat dissipation blower.

Moreover, according to the present invention, it is possible to minimize or prevent the leakage of air blown by an inverter heat dissipation blower, to effectively dissipate heat not only from the front but also from the rear of an inverter circuit board, and to effectively support the inverter circuit board by using an inverter guide.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. An induction heater, comprising:

an inverter body having an inlet formed in a bottom surface thereof;

an inverter circuit board provided within the inverter body;

an inverter heat dissipater mounted in the inverter body and contacting the bottom surface of the inverter body such that an inlet of the inverter heat dissipater is connected to the inlet of the inverter body, wherein the inverter heat dissipater is configured to blow air to a front and a rear of the inverter circuit board, the inverter heat dissipater comprising:

an inverter heat dissipation blower configured to blow air into at least one of a first inverter heat dissipation space formed between the inverter body and the inverter circuit board or a second inverter heat dissipation space formed between the inverter body and the inverter circuit board; and an inverter guide provided between the inverter body and the inverter circuit board and configured to guide air blown by the inverter heat dissipation blower to the inverter circuit board; and a heat sink provided on a top surface of the inverter circuit board, wherein the heat sink dissipates heat from the inverter circuit board, and wherein an outlet divider divides an outlet of the inverter heat dissipation blower so that more air is blown into the first inverter heat dissipation space than into the second inverter heat dissipation space, and wherein the inverter guide comprises a plurality of guide ribs each having an end portion thereof that is closest to the heat sink bent toward the heat sink.

2. The induction heater of claim 1, wherein the first inverter heat dissipation space is provided between a top surface of the inverter circuit board and the inverter body, and wherein the second inverter heat dissipation space is provided between a bottom surface of the inverter circuit board and the inverter body.

3. The induction heater of claim 2, wherein a first portion of an outlet of the inverter heat dissipation blower is configured to blow air into the first inverter heat dissipation space, and a second portion of the outlet of the inverter heat dissipation blower is configured to blow air into the second inverter heat dissipation space.

4. The induction heater of claim 3, wherein the outlet divider divides the outlet of the inverter heat dissipation blower into the first and second portions.

5. The induction heater of claim 2, wherein the inverter body comprises a plurality of outlets configured to guide air blown by the inverter heat dissipation blower out of the inverter body, the plurality of outlets comprising a first inverter body outlet configured to discharge air from the first inverter heat dissipation space and a second inverter body outlet configured to discharge air from the second inverter heat dissipation space.

6. The induction heater of claim 2, wherein the inverter body comprises an outlet configured to guide air blown by the inverter heat dissipation blower out of the inverter body, the outlet comprising a first portion configured to discharge air from the first inverter heat dissipation space and a second portion configured to discharge air from the second inverter heat dissipation space.

7. The induction heater of claim 2, wherein the inverter body has a substantially rectangular inner space, and the inverter heat dissipation blower is provided at a corner of the rectangular inner space of the inverter body.

8. The induction heater of claim 2, wherein the inverter body comprises:

an outlet provided on a side of the inverter body, wherein the inlet of the inverter body is configured to guide air blown by the inverter heat dissipation blower into the inverter body and the outlet of the inverter body is configured to guide air blown by the inverter heat dissipation blower to an outside of the inverter body.

9. The induction heater of claim 1, wherein the inverter guide is configured to support the inverter circuit board.

10. The induction heater of claim 1, wherein the inverter circuit board comprises both a first inverter circuit board and a second inverter circuit board provided within the inverter body, and the wherein the heat sink comprises:

a first heat sink provided on the first inverter circuit board and configured to dissipate heat from the first inverter circuit board; and a second heat sink provided on the second inverter circuit board and configured to dissipate heat from the second inverter circuit board, the first and second heat sinks being provided in a space between the first inverter circuit board and the second inverter circuit board proximate each other.

11. The induction heater of claim 10, wherein the inverter heat dissipation blower comprises:

a first inverter heat dissipation blower configured to blow air to the first inverter circuit board, wherein the first inverter heat dissipation blower corresponds to the first heat sink; and a second inverter heat dissipation blower configured to blow air to the second inverter circuit board, wherein the second inverter heat dissipation blower corresponds to the second heat sink.

12. The induction heater of claim 11, wherein the inverter guide comprises:

a first inverter guide configured to guide the air blown by the first inverter heat dissipation blower to the first inverter circuit board, but not to the first heat sink; and a second inverter guide configured to guide the air blown by the second inverter heat dissipation blower to the second inverter circuit board, but not to the second heat sink.

13. The induction heater of claim 10, wherein the inverter heat dissipation blower is configured to blow air to the first and second inverter circuit boards, wherein the inverter heat dissipation blower corresponds to both the first and second heat sinks.

14. The induction heater of claim 1, further comprising one or more induction coils provided on the inverter body, wherein the induction coils generate an induction field.

15. An induction heater, comprising:

an inverter circuit board;

an inverter body which defines a space configured to receive the inverter circuit board, the inverter body having an inlet formed in a bottom surface thereof;

a heat sink provided on a top surface of the inverter circuit board, wherein the heat sink dissipates heat from the inverter circuit board, and wherein an outlet divider divides an outlet of an inverter heat dissipation blower so that more air is blown into a first inverter heat dissipation space than into a second inverter heat dissipation space, the first and second inverter heat dissipation spaces each being formed between the inverter circuit board and the inverter body; and an inverter heat dissipater mounted in the inverter body and contacting the bottom surface of the inverter body such that an inlet of the inverter heat dissipater is connected to the inlet of the inverter body, wherein the inverter heat dissipater is configured to blow both a main air stream to a first portion of the inverter circuit board and a sub-air stream to a second portion of the inverter circuit board, wherein the inverter heat dissipater includes an inverter guide provided between the inverter body and the inverter circuit board and configured to guide air blown by an inverter heat dissipation blower to the inverter circuit board, and wherein the inverter guide comprises a plurality of guide ribs each having an end thereof that is closest to the heat sink bent toward the heat sink.

16. The induction heater of claim 15, wherein the first portion of the inverter circuit board comprises a front of the inverter circuit board, and the second portion of the inverter circuit board comprises a rear of the inverter circuit board.

17. The induction heater of claim 16, wherein the inverter heat dissipater is configured to support the inverter circuit board.

* * * * *